United States Patent [19]

Phillips

[11] 4,356,915

[45] Nov. 2, 1982

[54] CONTAINER FOR SPHERICAL OBJECTS

[76] Inventor: William L. Phillips, 1691 E. Weber Rd., Columbus, Ohio 43211

[21] Appl. No.: 310,298

[22] Filed: Oct. 9, 1981

[51] Int. Cl.[3] ..... B65D 85/00

[52] U.S. Cl. ..... 206/315 B; 224/919; 46/43; 46/47; 273/109

[58] Field of Search ..... 206/315 B, 457, 538, 206/539, 533, 540; 224/274, 919; 220/DIG. 13; 273/109; 46/43, 47, 52, 111, 114; D3/36; D9/302, 306, 329, 339, 353, 414, 424; 312/49; 211/19; 21/64, 65

[56] References Cited

U.S. PATENT DOCUMENTS

| | | | |
|---|---|---|---|
| D.171,950 | 4/1954 | Moore | D21/65 |
| 1,259,889 | 3/1918 | MacDonald | 46/114 |
| 1,817,562 | 8/1931 | Hodge | 206/45.34 |
| 1,983,499 | 12/1934 | Rosenthal | 206/315 B |
| 2,221,704 | 11/1940 | Farley | 211/14 X |
| 2,412,332 | 12/1946 | Hansen | 220/20 X |
| 3,908,825 | 9/1975 | Ayoub et al. | 220/20 X |
| 4,061,256 | 12/1977 | Beer et al. | 224/919 X |

*Primary Examiner*—Steven M. Pollard
*Assistant Examiner*—Bryon Gehman

[57] ABSTRACT

A container for spherical objects such as game marbles comprising a hollow torus shaped housing in which objects are admitted to the hollow of the housing by means of an aperture in the housing which is covered or uncovered by a movable closure member. In a preferred embodiment the container includes a hub having an elastic concave receptacle for a shooter marble and the hub is supported within the torus shape of the housing by a plurality of spokes connected to the housing.

7 Claims, 3 Drawing Figures

CONTAINER FOR SPHERICAL OBJECTS

SUMMARY OF THE INVENTION

This invention relates to a container for spherical objects such as glass marbles. More particularly it relates to a container for such objects which is in the shape of a torus (analogous to a hollow doughnut) in which the objects are contained within the hollow of the torus.

Briefly, and in summary the invention is a container comprising: a hollow torus-shaped housing with the internal cross-sectional diameter of the housing being conveniently larger than the diameter of the spherical objects it will contain, with at least one aperture in the surface of the housing, the aperture being conveniently larger than the objects being contained; and a closure member constructed to snap or press fit over and cover the housing and aperture, the closure member being movable so that the aperture may be covered or uncovered for the admission or removal of stored objects.

The storage of spherical articles and particularly marbles of the type used in children's games has been the subject of various efforts to provide a suitable device. A conventional approach is that disclosed in U.S. Pat. Nos. 2,221,704 and 3,908,825 in which a cylindrical turret-like construction is used having longitudinal slots for storing the marbles allowing extraction at the ends. Other approaches include those shown in U.S. Pat. Nos. 1,817,562 and 2,412,332 in which the objects are carried in slots or compartments that are accessible by means of rotating a closure member which is moved to a position above an opening over the compartment that is to be accessed.

These previous constructions fall short of completely meeting the desirable objectives in one manner or another. The first two patents have the drawback that one or more marbles must be removed from a slot to obtain another one located between the ends of the slot, i.e., adjacent marbles must be removed before a user can obtain the one wanted. In addition, the construction is relatively complex, cumbersome and expensive to manufacture. The latter two patents are examples of the typical turret-type construction with provisions for opening at each compartment position.

It is an object of the present invention to provide a container which is simple in construction, durable in use, efficient in operation, convenient to display at retail outlets, appealing to the senses and economical manufacture. It is a further object to simplify and consequently decrease the cost of manufacture of a container for marbles, by constructing it of only three parts, two of which are identical. The parts are constructed and formed for standard molded plastic manufacture.

Containers for glass game marbles should have special features. The marbles should be visible in the container and easily accessible individually. The container should be readily portable, easily displayed and very inexpensive.

The present invention uniquely meets the above desirable features because the torus shape is readily made of transparent, inexpensive, moldable material in only three parts, two of which are identical; there is ready accessibility to any particularly selected marble, which is plainly and attractively visible; the surfaces are easily grasped in the users hand for ready carrying and lending itself to convenient shelf or peg storage at retail outlets; and the container is manufacturable in a most simple and inexpensive manner.

The foregoing and other advantages of the invention will become apparent from the following disclosure in which a preferred embodiment of the invention is described in detail and illustrated in the accompanying drawings. It is contemplated that variations in procedures, structural features and arrangements of parts may appear to the person skilled in the art, without departing from the scope or sacrificing any of the advantages of the invention.

DETAILED DESCRIPTION OF THE INVENTION

Figure 1:
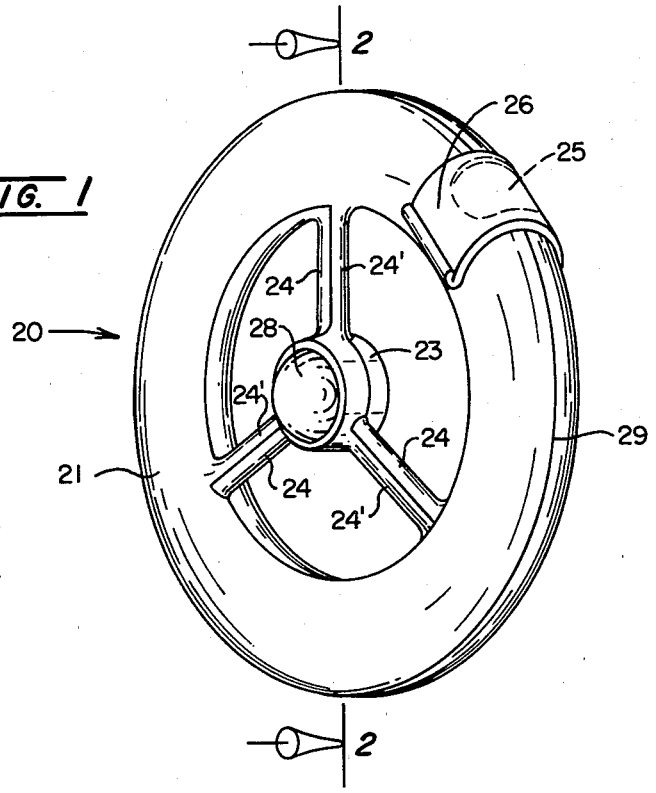
FIG. 1 is a perspective view of the container of this invention.
Figure 2:
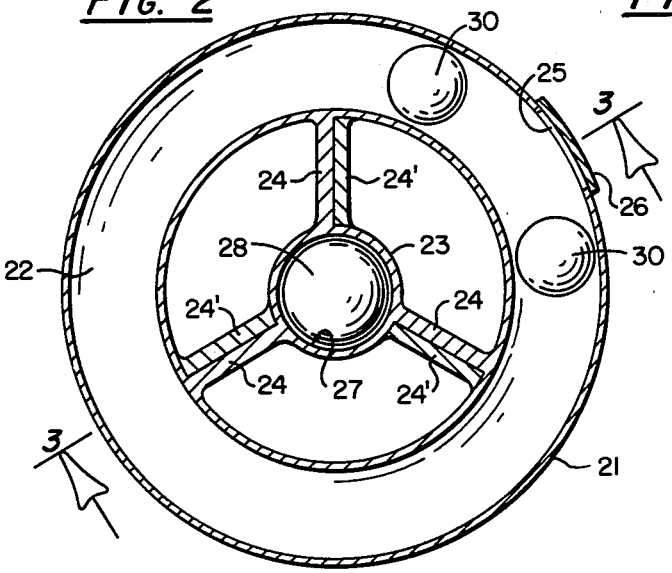
FIG. 2 is an elevational cross-section view of this invention taken along the line 2—2 of FIG. 1.
Figure 3:
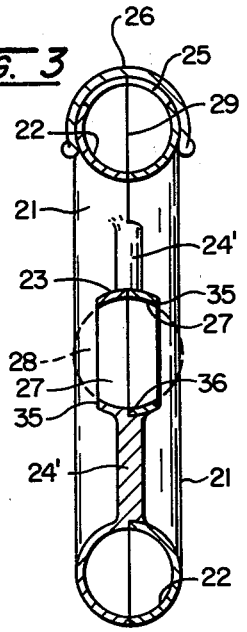
FIG. 3 is a cross-sectional elevation view taken along the line 3—3 of FIG. 2.

Referring to FIGS. 1, 2 and 3, a generally torus shaped container 20 is constructed of an outer circular housing 21 having walls 22 that are circular in cross-section. A hub 23 is axially supported at the center of the container 20 by a plurality of spokes 24, 24'. The housing 21 is provided with an aperture 25 which is covered by a closure member 26.

The housing 21 is provided with an internal diameter conveniently larger than the outside diameter of a storage spherical object 30, for which it is to be used as a container. The internal diameter is not critical and may be almost any size so long as it is greater than the outside diameter of the spherical object to be stored.

The closure member 26 is constructed so it encircles at least more than half of the outer circumference of the housing 21 when in place over the aperture 25, as shown in FIG. 1. The closure member 26 is constructed of a resilient rigid material. It is formed in its unassembled position to a radius slightly smaller than the outside diameter of housing 21 so that it can be placed on housing 21 by resilient deformation to slip over housing 21 and remain in place by an exerted pressure resulting from its stretched condition.

The closure member 26 may also be moved from its closed position over the aperture 25 by sliding it circumferentially in either direction.

In an alternate construction, the closure member is one that completely encircles the housing cross-section in the manner of an accurate portion of a larger torus, i.e., a portion of a sleeve. The sleeve may be used as a closure member by sliding it circumferentially in either direction to cover or uncover the aperture.

The housing 22 is preferably constructed of two mating sides or halves which meet on a line 29 that is in a plane passing through the centerline axis of the housing. This plane is perpendicular to the central axis of the torus shape of the housing. The sides are identical. In the preferred embodiment, each side is formed with opposing spokes 24, 24' supporting a half portion 27 of the hub 23.

The container 20 is assembled by concentrically positioning the two identically formed but symmetrically turned side "halves" together and fastening them with a suitable adhesive cement or other method of joining.

When assembled, the container has a plurality of symmetrically disposed radial spokes 24, 24'. In the preferred embodiment shown, the assembled container 20 has three such spokes 24, 24', but by proper design other numbers of spokes could be used.

The hub 23 is somewhat thicker than the spokes 24, 24' and has an inner concave form, of which the inside diameter and curvature is constructed slightly smaller than the outside diameter and curvature of a spherical object it is intended to hold, such as the "shooter" marble 28 in the game of marbles. It is well known that the shooter marble is slightly larger than the target marbles and is therefore of special value to the players in the game of marbles. The shooter marble 28 may be pressed or snapped into and out of the hub 23 as needed, past the outside edge 35, resiliently deforming the hub as necessary to put the shooter 28 into a retained carrier position, as shown in FIGS. 1 and 3.

When the spherical objects 30 to be contained are game marbles, the container 20 is preferably constructed of a transparent, either clear or colored, polyethylene or polystyrene plastic material by molding with a well known conventional plastic molding process such as blow molding or injection molding. In a transparent plastic construction the marbles 30 will be visible and their own brilliant colors and patterns will be apparent to view from the outside of the container. This has several advantages such as making it possible to view and select a particular marble. The selected marble may be brought to a recovery position at the aperture 25 by rotation of the container 20. It may then be removed from the container 20 without removing the rest of the marbles. Also, the visibility of the marbles creates an attractive package so that the marbles 30 and the container 20 may be displayed and sold as a single unit.

It is herein understood that although the present invention has been specifically disclosed with the preferred embodiments and examples, modifications and variations of the concepts herein disclosed may be resorted to by those skilled in the art. Such modifications and variations are considered to be within the scope of the invention and the appended claims.

What is claimed is:

1. A container for storing spherical objects comprising:

a. a hollow torus-shaped housing with the internal cross-sectional diameter thereof being conveniently larger than the outside diameter of the spherical objects to be stored, and with at least one aperture in the surface of the housing, the aperture being conveniently larger than the outside diameter of the objects; and b. a closure member constructed to fit over and cover the aperture to prevent the passage of spherical objects stored within the hollow of the housing to the outside, and movable to uncover the aperture for the admission and removal of the spherical objects to and from the interior of the housing.

2. A container according to claim 1 wherein a hub is supported by the housing, and the hub is provided with a concave internal form in which a spherical object may be impressed by elastic deformation.

3. A container according to claim 2 wherein the container is constructed of molded, transparent plastic material for the display, sale and storage of game marbles and the hub is constructed to receive and hold a larger shooter marble.

4. A container according to claim 2 wherein the hub member is supported by a plurality of spokes between the hub and the housing.

5. A container according to claim 1 wherein the housing comprises two identical halves, with one oppositely turned with respect to the other and fastened together concentrically to form the hollow torus shape of the housing.

6. A container according to claim 1 constructed of molded, transparent material for the display, sale and storage of game marbles.

7. A container for game marbles comprising:

a. a hollow torus-shaped housing with the internal cross-sectional diameter thereof being conveniently larger than the outside diameter of the game marbles, and with at least one aperture in the surface of the housing, the aperture being conveniently larger than the outside diameter of the game marbles;

b. a closure member constructed to fit over and cover the aperture to prevent game marbles from passing from the interior of the housing to the outside, and with the closure member movable to uncover the aperture for the admission and removal of game marbles to and from the interior of the housing;

c. a hub coaxially supported by the housing by a plurality of radial spoke means connected to the housing and to the hub, the hub having an internal concave form with a diameter and curvature slightly smaller than the external diameter of a game shooter marble, the hub being elastically deformable to admit the game shooter marble and to retain the game shooter marble therein; and d. the material of the housing, hub and spokes being a moldable transparent semi-rigid elastically deformable material.

* * * * *